United States Patent [19]

Tanner et al.

[11] 4,416,329

[45] Nov. 22, 1983

[54] OIL WELL SETUP AND PUMPING APPARATUS

[75] Inventors: Curtis J. Tanner, San Diego; Richard E. Bender, Escondido; Anton K. Simson, Poway; Hugh McCutchen, Jr., San Diego, all of Calif.

[73] Assignee: Henlan, Inc., Midland, Tex.

[21] Appl. No.: 292,590

[22] Filed: Aug. 13, 1981

[51] Int. Cl.[3] ..... E21B 17/00; E21B 17/04; E21B 19/08

[52] U.S. Cl. ..... 166/68; 166/72; 166/385; 403/339; 403/341

[58] Field of Search ..... 166/67, 68, 72, 77, 166/105, 105.2, 385; 428/58, 68, 71, 76, 268, 365, 408, 476.3; 403/339, 340, 341

[56] References Cited

U.S. PATENT DOCUMENTS

| | | | |
|---|---|---|---|
| 862,403 | 8/1907 | Lahue | 428/365 |
| 3,086,071 | 4/1963 | Preston | 428/268 |
| 3,116,793 | 1/1964 | McStravick | 166/77 |
| 3,559,905 | 2/1971 | Palynchuk | 166/77 |
| 3,690,136 | 9/1972 | Slator et al. | 166/77 |
| 4,024,913 | 5/1977 | Grable | 166/242 |

*Primary Examiner*—Stephen J. Novosad
*Assistant Examiner*—Joseph Falk
*Attorney, Agent, or Firm*—Watson, Cole, Grindle & Watson

[57] ABSTRACT

A continuous length of reinforced plastic ribbon rod is wound on a reel and replaces a conventional oil well sucker rod formed of long sections of steel rods. The reinforced plastic has a high modulus of elasticity, is sufficiently stiff for use in pumping, and has enough flexibility to be wound onto a reel or drum. The reel of ribbon rod is positioned above oil well tubing and the ribbon rod, with an oil pump attached to its free end, is fed into the tubing and lowered to the bottom of the well. The ribbon rod is secured to a surface pumping means, and reciprocating motion is transmitted to the oil pump through the ribbon rod.

14 Claims, 15 Drawing Figures

OIL WELL SETUP AND PUMPING APPARATUS

BACKGROUND OF THE INVENTION

Conventional oil well pumping systems use a sucker rod formed of sections of steel rod in excess of twenty feet long connected together to reach the bottom of the oil well. An oil pump is connected to the end of the sucker rod at the bottom of the well. An average depth of an oil well is approximately 5,000 feet. The top of the sucker rod is secured to an energizing source at the surface of the ground and the energizing source reciprocates the sucker rod and oil pump to bring oil to the surface of the well. A typical energy source is the horse head pumping installation seen on active wells. The long sections of steel rod are heavy and cumbersome and also dangerous to handle when forming the complete length of a sucker rod. The weight of a steel sucker rod requires considerable power to operate the oil pump at the bottom of the well. In addition, the corrosive environment in an oil well adversely affects a steel sucker rod which shortens its operating life.

SUMMARY OF THE INVENTION

An exemplary embodiment of the present invention overcomes the problem of the prior art by providing oil well setup and pumping apparatus including a continuous ribbon rod of reinforced plastic ribbon wound on portable reel means whereby an oil pump is affixed to the end of the ribbon rod and is guided into the well tubing from the reel means, the reel means paying out the ribbon rod to the proper depth and the free end of the ribbon rod then being affixed to an energy source for reciprocating pump action.

This results in use of less energy, much easier handling, longer periods of time between rod repair or replacement and a safer, more dependable construction.

DETAILED DESCRIPTION OF THE INVENTION

Figure 1:
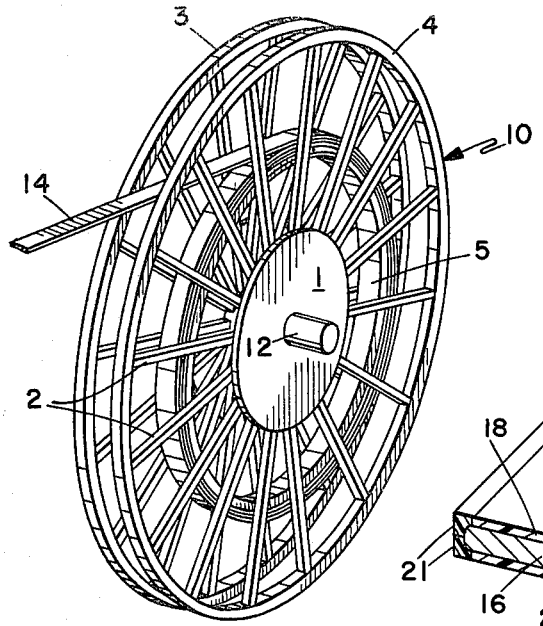
FIG. 1 is a perspective view of a reel with the ribbon rod of the present invention wound thereon.
Figure 2:
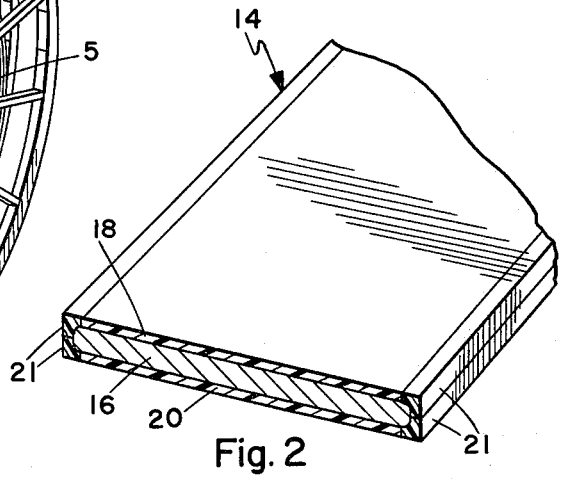
FIG. 2 is an enlarged perspective of a portion of ribbon rod showing face and corner strips positioned on the core.

A reel 10 is shown in FIG. 1 of the drawings. The reel includes an axle 12 mounted at the center. A continuous length of ribbon rod 14 (FIG. 2) is wound on the reel. The ribbon rod is formed of a core 16 of high strength, low density material having a high modulus of elasticity such as graphite fiber reinforced Vinylester.

A modulus of elasticity on the order of about fifty or fifty-five million pounds per square inch works extremely well. Union Carbide P-55 is an example of such a graphite fiber. The ribbon is formed by saturating bundles of fibers or filaments of this graphite with a thermosetting resin and pulling the wetted mass through a heated forming die. The faces of the ribbon rod are covered with plies 18 and 20 of a woven material such as glass fabric to provide transverse strength. Glass or Kevlar corner tows 21 facilitate the pultrusion process used in making the ribbon rod and provide increased damage tolerance. A typical ribbon rod has a width on the order of about one and four-tenths inches and a thickness on the order of about eight-hundreths of an inch. This ribbon rod is stiff and strong enough to transmit oil well pumping loads and is flexible enough for winding on a reel having a spool that is on the order of six feet in diameter for example. This material is highly resistant to the corrosive environment found in an oil well.

Figure 9:
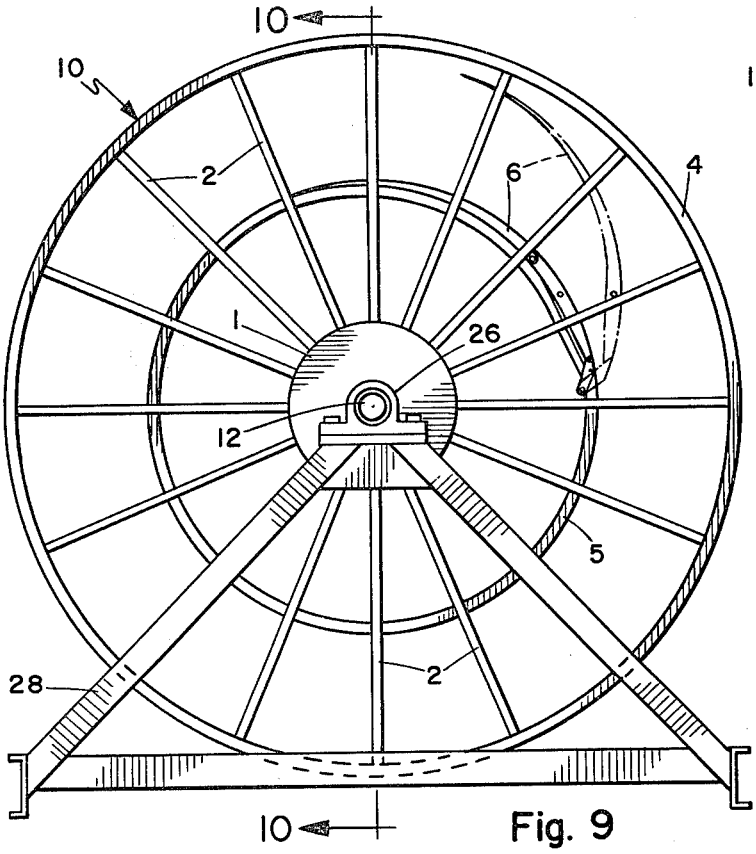
FIG. 9 is a side elevation view of the reel and its supporting structure.
Figure 13:
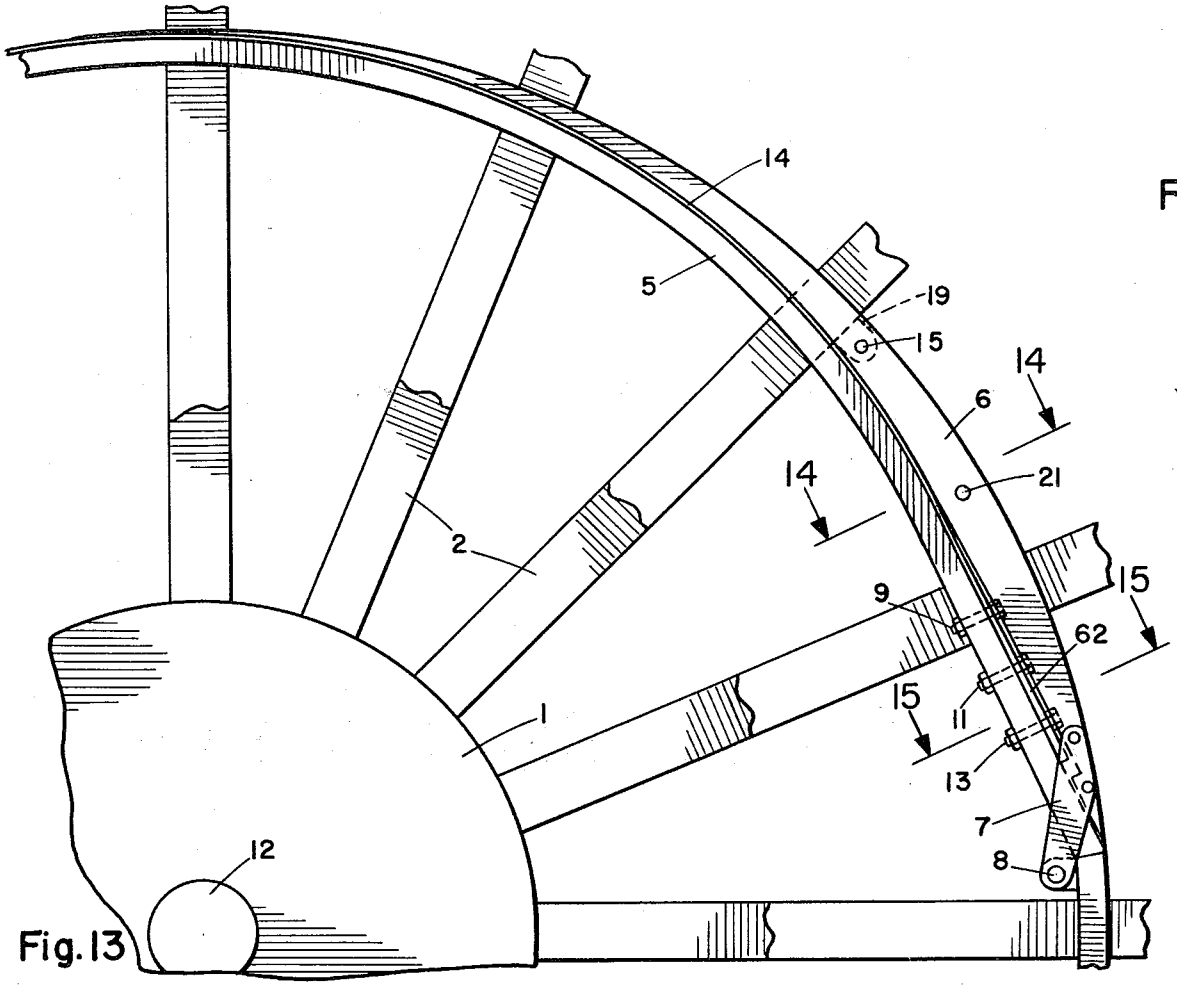
FIG. 13 is an enlarged view of a portion of FIG. 9, with the near side spokes of the reel cut away to show the ribbon rod end fastening.

Referring to FIGS. 1, 9 and 13, the reel includes a hub referred to generally at 1. Spokes 2 extend radially outward from the hub on each side of the hub and are connected to a pair of rims 3 and 4. A circular ribbon rod support member 5 is attached to the spokes 2. The support includes a ribbon rod connection portion including a curved gate 6 which is shaped to permit smooth winding of the ribbon rod on the reel without abrupt bending. The gate 6 is attached to a pair of gate support arms 7, one on each side of the ribbon rod support member 5. The arms 7 are pivotally connected to the ribbon rod support member at 8. Gate 6 is pivoted about pivot point 8 to the open position shown in dotted lines (FIG. 9) and stop pin 21 engages the spokes 3 and 4 to prevent the gate from overswinging. When the end of a ribbon rod with a reinforcing doubler attached thereto is positioned in the reel, the holes in the doubler on the end of the ribbon rod (described later herein) are aligned with holes in the ribbon rod support member 5 and the end of the doubler is connected to the ribbon rod support member 5 with the bolt assemblies 9, 11, and 13. The gate 6 is closed down on the ribbon rod and is held in the closed position by a pin 15 which is inserted through a hole 17 in the gate and through holes in lugs 19 connected to spokes 2 on each side of the reel. The ribbon rod is wound onto the ribbon rod support member 5 and passes smoothly over the outer curved surface of gate 6 without abrupt bending.

Figure 3:
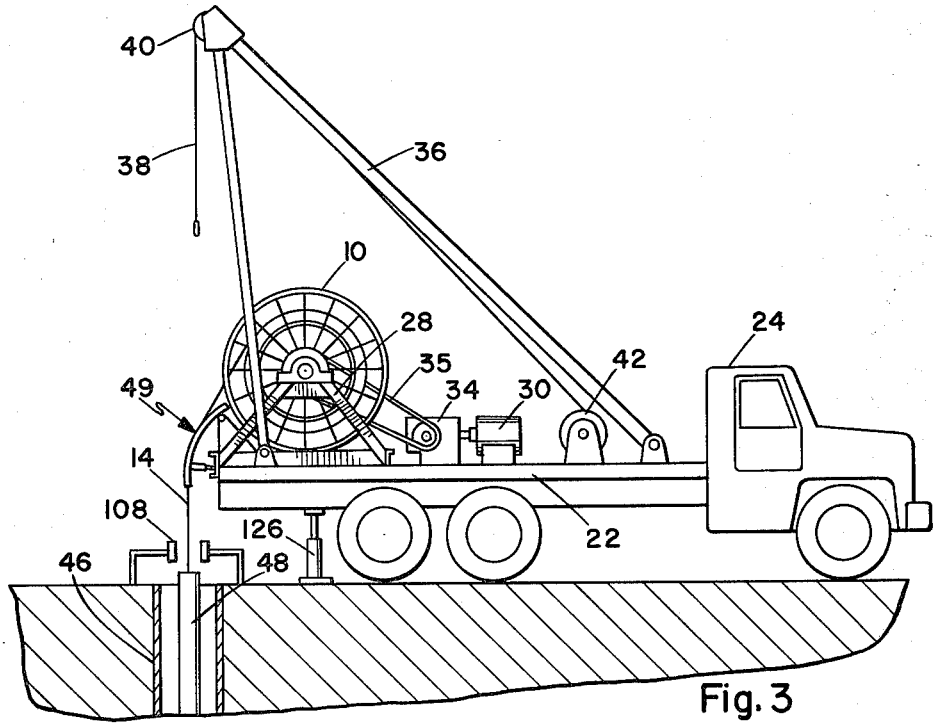
FIG. 3 is a side elevation of the steel shown in FIG. 1 positioned on a truck bed with a ribbon rod guide in place and the truck located to feed the ribbon rod into the oil well.
Figure 4:
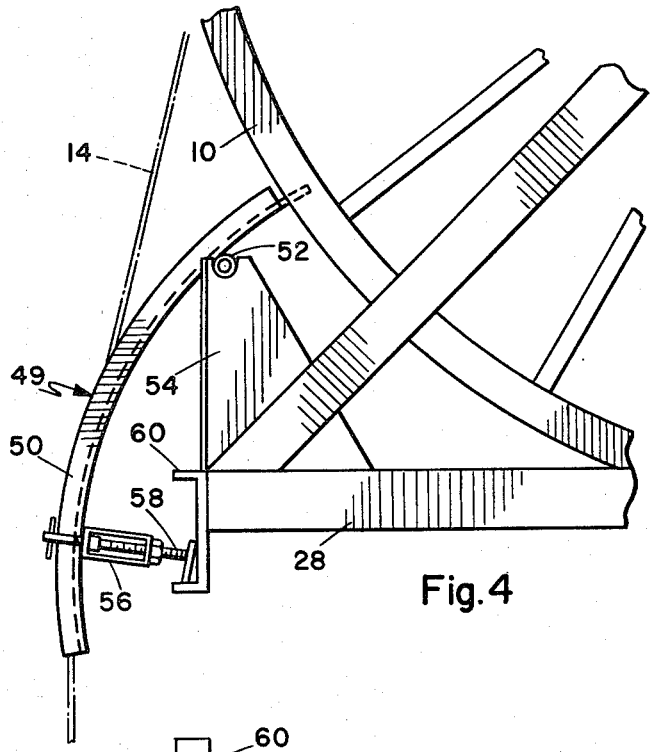
FIG. 4 is an enlarged detail view of the ribbon rod guide shown at the back of the truck bed in FIG. 3.
Figure 5:
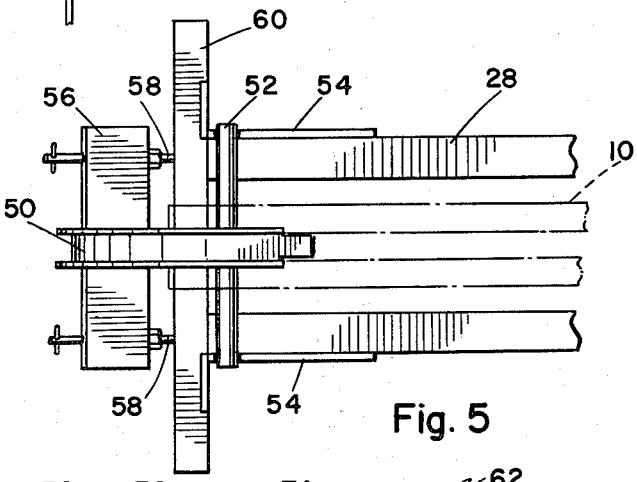
FIG. 5 is a plan view of the ribbon rod guide shown in FIG. 4.
Figure 10:
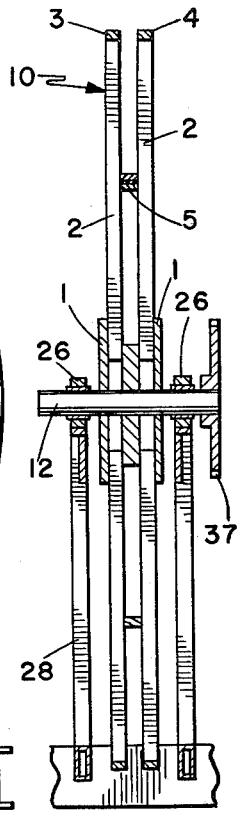
FIG. 10 is a sectional view taken on line 10—10 of FIG. 9.

FIG. 3 of the drawings shows the reel 10 mounted on the bed 22 of truck 24. Referring to FIG. 9, the axle 12 of reel 10 is mounted in pillow blocks 26 on the reel support frame 28 which is affixed to truck bed 22. The reel 10 is rotatable by the motor 30 positioned on the truck bed through the worm gear reducer 34. A chain 35 runs from the worm gear reducer 34 to a sprocket 37 (FIG. 10) on the axle of reel 10. The worm gear reducer prevents the ribbon rod from free running off the reel. Ribbon rod 14 is fed into the well and removed from the well by the chain drive to the reel. A rigging frame 36 is contained on the truck 24 and a line 38 extends over a pulley 40 to a winch 42. This line is used to handle the attachment of a pump, sinker weights and polished rod as will be explained later. The truck 24 is shown in FIG. 3 positioned adjacent an oil well, including the casing 46 and the tubing 48. The ribbon rod 14 is fed through a guide 49 to position the ribbon rod directly over the oil well tubing 48. Referring to FIGS. 4 and 5 of the drawings, it will be seen that the guide includes a curved guide track 50 which is channel-shaped for seating the ribbon rod 14. The upper end of the guide track is removably affixed by a hinge pin 52 to brackets 54 which are attached to frame 28. A cross bar 56 secured near the lower end of guide track 50 carries an adjustment screw 58 which engages a cross beam 60 on the frame 28 so that as the screw is rotated, the track 50 is moved toward or away from the truck bed until it is aligned over the oil well tubing 48.

Figure 6:
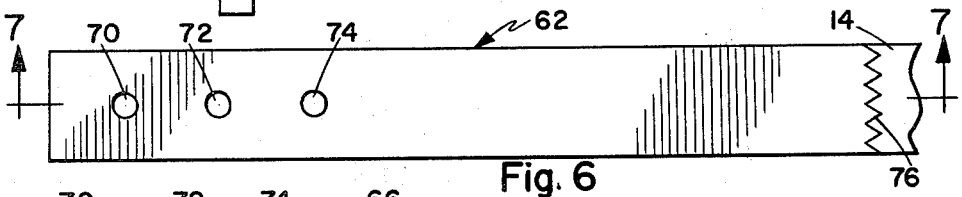
FIG. 6 is a plan view of a section of the ribbon rod with a reinforcing doubler formed on the end thereof.
Figure 7:
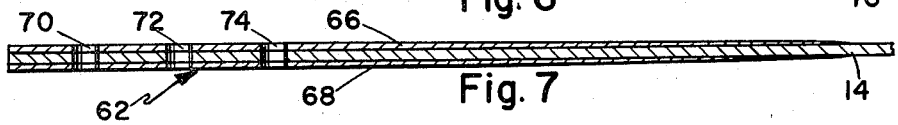
FIG. 7 is a sectional view taken on line 7—7 of FIG. 6.

Once the truck is in position and the guide 49 has been adjusted, the end of ribbon rod 14 is pulled from reel 10. The end of the ribbon rod includes a reinforcing doubler 62 as shown in FIGS. 6 and 7 of the drawings. The doubler is formed by placing a tapered reinforced plastic end section 66 on one face of the rod 14 and a tapered end section 68 on the other face of the rod. These sections are then bonded in place on the rod to provide a strong doubler to react to bolt loads. Holes 70, 72 and 74 are drilled in the doubler. The interior end of each section 66 and 68 is cut to a serrated configuration 76 to provide a better bond.

Figure 8:
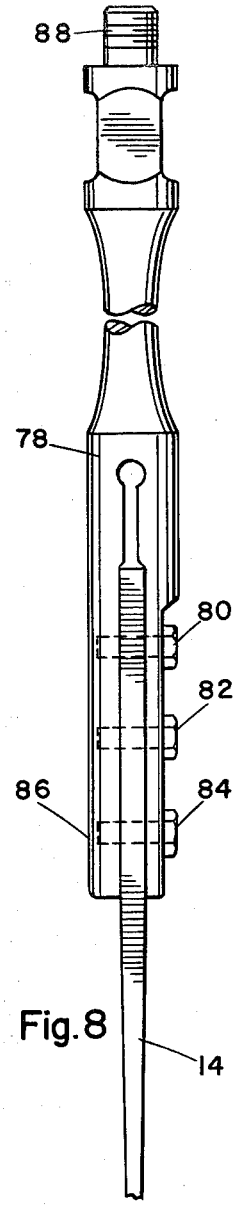
FIG. 8 is a side elevation of a coupling affixed to the end of the ribbon rod.
Figure 16:
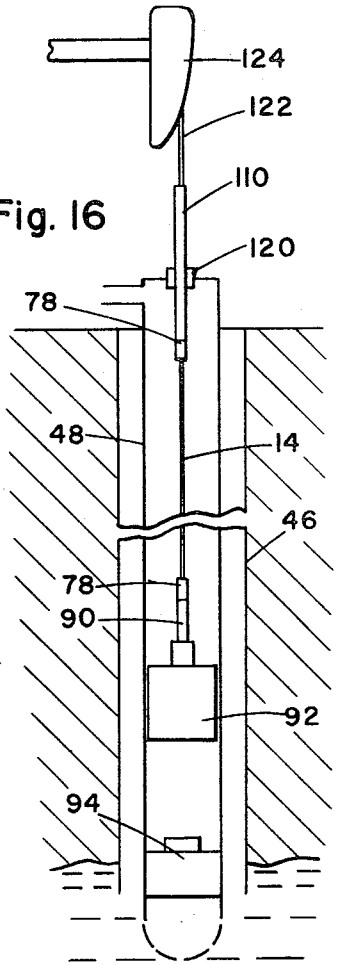
FIG. 16 illustrates diagrammatically the installation of the ribbon rod in an oil well.

FIG. 8 of the drawings shows the end of the ribbon rod 14, with the doubler attached in place, inserted in the end of a coupling 78 which is slotted at one end to receive the ribbon rod 14. The coupling is made from a high corrosion resistant steel, and bolts 80, 82 and 84 are passed through the openings in the doubler into threaded portions in the lower leg 86 of the coupling. The bolts are formed of a high strength, corrosion resistant material such as stainless steel. The entire end 88 of the coupler is a standard American Petroleum Institute configuration. FIG. 16 shows the lower end of ribbon rod 14 with the coupling 78 attached to a steel sinker weight rod 90 that in turn is connected to the upper section 92 of the oil well pump and the upper end with coupling 78 attached to polished rod 110. One or more sinker weight rods may be used. The sinker weight rods are positioned between the ribbon rod and the upper pump section 92 or plunger to maintain tension in the ribbon rod and provide a mass to facilitate dynamic tuning of the string to magnify the stroke of the plunger. The pump is lowered into the tubing 48 until the lower section 94 is seated. When the ribbon rod 14 is pulled upward thereafter, the upper pump section moves upward off the lower section and oil is drawn through a valve (not shown). When the upper pump section 92 is moved down again, oil moves through a valve (not shown) in the upper pump section.

Figure 11:
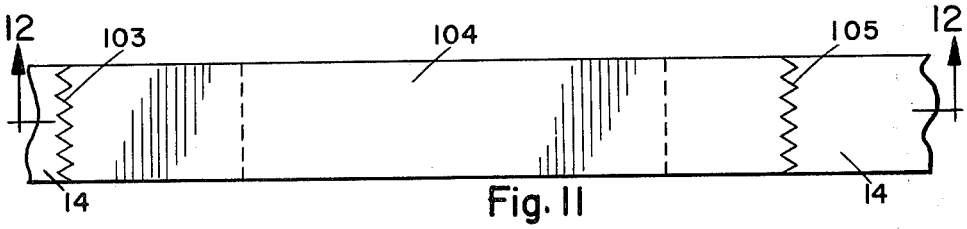
FIG. 11 is a plan view of a splice joint of two lengths of ribbon rod.
Figure 12:
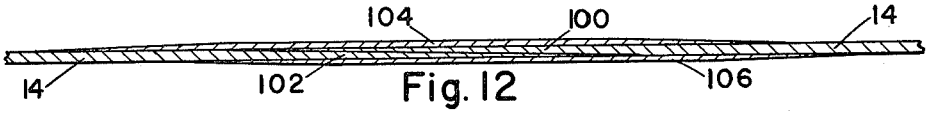
FIG. 12 is a sectional view taken on line 12—12 of FIG. 11.
Figure 14:
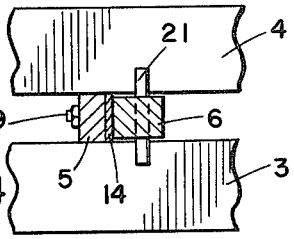
FIG. 14 is a sectional view taken on line 14—14 of FIG. 13.
Figure 15:
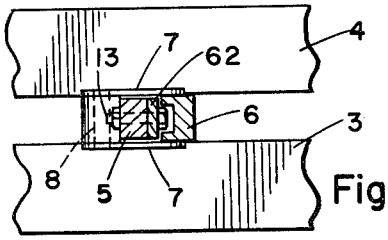
FIG. 15 is a sectional view taken on line 15—15 of FIG. 13.

The ribbon rod 14 can be formed or repaired in sections as shown in FIGS. 11 and 12 of the drawings. The ends 100 and 102 of two ribbon rod sections are tapered so that the ribbon rod does not increase in thickness when these two ends are bonded together. Splice straps 104 and 106 overlay the end sections and are tapered and bonded to the ribbon rod sections. The ends of the two splice strap sections are staggered relative to each other to minimize stress concentrations and to provide a smooth thickness change to facilitate reeling. The ends of the ribbon rod sections and splice straps all are serrated, as shown at the ends 103 and 105 of splice strap 104 in FIG. 11, to provide an effective bond.

With the guide 49 in FIG. 3 removed, the pump and sinker weights are lowered into the well with the hoist. With the top sinker weight supported on conventional sucker rod elevators (not shown) adjacent to the well, an end coupling 78 is attached. The guide 49 is placed into position and the ribbon rod 14 is guided in the channel of the guide track 50 and attached to the coupling. The oil pump is lowered into the tubing 48. Slips 108 are positioned over the well casing 46 to hold the ribbon rod 14 after the pump is lowered into the tubing as shown in FIG. 16.

After the pump is positioned in the well, slips 108 frictionally engage the ribbon rod to hold it in position. An end coupling such as shown in FIG. 8 is secured to the ribbon rod 14, and a polished rod 110 is fastened to the end 88 of the coupling. The polished rod is placed in position with the line 38, FIG. 3. When the polished rod is in place, then slips 108 are disengaged and removed from over the oil well casing and a bearing member or stuffing box 120 is set in place (FIG. 16). The polished rod 110 is secured to a bridle 122 which is connected to the horse head 124 of the usual surface energy source or pump and the rig is ready for pumping.

As shown in FIG. 3 of the drawings, the rear end of the truck bed is supported by a jack or jacks 126 when the ribbon rod 14 is properly centered in the tubing 48. This provides additional support for the reel 10.

Additional reels can be stacked laterally across the truck bed 22 and the ends of the ribbon rod can be joined with a pair of couplers 78. Also, more than one ribbon rod can be secured to the oil well pump section 92 because of the small size and light weight of the ribbon rod. This increases the strength of the ribbon rod means without compromising reelability of the ribbon rod means. It also provides a fall safe construction.

The ribbon rod of the present invention has a higher specific tensile modulus and higher allowable working stress than steel sucker rods. This results in a large weight saving which in turn reduces load and energy requirements of the pumping unit and makes downsizing of the surface unit possible. The light weight and high fatigue strength of the ribbon rod allow pumping from greater depths than can be pumped with conventional steel sucker rods.

The capability of the ribbon rod to be fabricated by the pultrusion process onto a reel facilitates handling and transportation and reduces manhours required to raise and lower the ribbon rod, pump and equipment in an oil well.

The resistance of the ribbon rod to corrosive environment of the oil well results in longer life, fewer failures, less downtime and reduced maintenance. The profitable life of low production wells is extended and energy production is increased.

We claim:

1. Oil well apparatus for use with an oil well having tubing therein, comprising:

relatively small diameter reel means including means for conveniently mounting on a truck;

a continuous length of relatively stiff fiber reinforced plastic ribbon means having a limited degree of flexibility for inserting in said tubing, said ribbon means being wound on said reel means and formed of low density materials having high fatigue endurance and the fiber reinforcement having a modulus of elasticity on the order of about fifty million pounds per square inch;

means for rotating said reel means; and coupling means on the end of said ribbon means for attaching oil pumping means to said ribbon means;

said oil pump means being inserted into the oil well tubing and said ribbon means being unrolled from said reel means to position said oil pump means in said tubing near the bottom thereof, the top of said ribbon means thereafter being connected to a polished rod that in turn is connected to a power source for reciprocating said ribbon means and activating said oil pump means.

2. Oil well apparatus according to claim 1 including adjustable guide means adjacent said reel means for guiding said ribbon means when it is unrolled from said reel means.

3. Oil well apparatus according to claim 1 including slip means for positioning adjacent said ribbon means for selectively clamping said ribbon means in position.

4. Oil well apparatus according to claim 1 wherein said ribbon means includes a ribbon of reinforced plastic material formed of multiple lengths and wherein the adjacent ends of each length are tapered toward the end, the tapered ends of each length overlapping and bonded together, and splice straps are positioned on each face of said ribbon rod sections for bonding thereto so that the thickness of said ribbon sections is not increased significantly at the joint, said splice straps and ribbon rods being serrated at the ends, and the splice straps being staggered to smoothly increase the thickness and facilitate reeling.

5. Oil well apparatus according to claim 1 wherein termination means is provided at the end thereof including reinforcing straps on each face of said ribbon means along the end portion, said reinforcing straps being tapered inwardly away from the end of said ribbon means and bonded to said ribbon means with a substantially saw tooth configuration at the tapered end of said straps.

6. Oil well apparatus according to claim 5 including coupler means for affixing said termination means to said oil pump means, said coupler means being bifurcated at one end for receiving said ribbon rod termination means and having connection means at its other end for connection to said oil pump means; and means for affixing said termination means in position in said coupler means.

7. Oil well apparatus according to claim 1 wherein said ribbon means is formed with graphite fiber reinforced plastic.

8. Oil well apparatus according to claim 7 wherein weight means is positioned between said coupling means and said oil pump means for maintaining tension in said ribbon means and facilitating dynamic tuning.

9. Oil well apparatus according to claim 7 wherein face strips of woven fabric are bonded on the faces of said plastic ribbon to provide transverse bending strength and stiffness; and an edge protection strip is provided on each edge of said plastic ribbon.

10. Oil well apparatus according to claim 1 wherein said ribbon means is formed with vinylester resin.

11. Oil well apparatus according to claim 1 wherein said ribbon means is formed with epoxy resin.

12. Oil well apparatus for use with an oil well having tubing therein, according to claim 1, including a circular ribbon means support on said reel means;

a curved gate member pivotally attached to said reel means and having an outer contour substantially coinciding with the curvature of said ribbon means support;

means for connecting the end of said ribbon means to said ribbon means support; and locking means for locking said gate member to said reel means when it is closed over the end of said ribbon means;

the outer and inner curved surface of said gate accommodating the wrapping of said ribbon means on said reel means without abrupt bending.

13. Oil well apparatus for use with an oil well having tubing therein according to claim 12 wherein said reel means includes a hub with spokes extending radially therefrom on each side of said hub and said locking means is positioned on certain of said spokes.

14. A ribbon rod for use in oil well apparatus to replace a conventional steel sucker rod, comprising:

an elongated ribbon of relatively stiff fiber reinforced plastic having a limited degree of flexibility with the reinforcing fibers having a modulus of elasticity on the order of about fifty five million pounds per square inch so that said ribbon will effectively transmit pumping forces and be windable upon a reel; and face strips of woven fabric bonded on the faces of said ribbon to provide transverse bending strength and stiffness; and an edge protection strip formed of material such as glass or Kevlar bonded to each edge of said ribbon, said edge strips facilitating the pultrusion process used in making said ribbon.

* * * * *